US010247504B2

(12) United States Patent
Oesmann et al.

(10) Patent No.: US 10,247,504 B2
(45) Date of Patent: Apr. 2, 2019

(54) MILITARY VESSEL

(71) Applicants: ThyssenKrupp Marine Systems GmbH, Kiel (DE); ThyssenKrupp AG, Essen (DE)

(72) Inventors: Hans Oesmann, Hamburg (DE); Dirk Ewers, Rosengarten (DE)

(73) Assignees: THYSSENKRUPP MARINE SYSTEMS GMBH, Kiel (DE); THYSSENKRUPP AG, Essen (DE)

( * ) Notice: Subject to any disclaimer, the term of this patent is extended or adjusted under 35 U.S.C. 154(b) by 82 days.

(21) Appl. No.: 15/516,702

(22) PCT Filed: Aug. 18, 2015

(86) PCT No.: PCT/EP2015/068890

§ 371 (c)(1),
(2) Date: Apr. 4, 2017

(87) PCT Pub. No.: WO2016/055206

PCT Pub. Date: Apr. 14, 2016

(65) Prior Publication Data

US 2017/0299318 A1 Oct. 19, 2017

(30) Foreign Application Priority Data

Oct. 18, 2014 (DE) ..... 10 2014 114 571

(51) Int. Cl.
*H01Q 1/08* (2006.01)
*F41A 27/02* (2006.01)
(Continued)

(52) U.S. Cl.
CPC ..... *F41A 27/02* (2013.01); *F41A 17/08* (2013.01); *H01Q 1/084* (2013.01); *H01Q 1/22* (2013.01);
(Continued)

(58) Field of Classification Search
CPC . F41A 27/02; H01Q 3/08; H01Q 1/52; H01Q 1/428; H01Q 1/22
(Continued)

(56) References Cited

U.S. PATENT DOCUMENTS 4,004,729 A * 1/1977 Rawicz ..... F41G 5/08 235/404
4,164,165 A 8/1979 Bean et al.
(Continued)

FOREIGN PATENT DOCUMENTS

KR 1020090072252 A 7/2009
KR 1020110055240 A 5/2011
KR 1020130134700 A 12/2013

OTHER PUBLICATIONS

English abstract of KR1020110055240.
English abstract of KR1020130134700.
English translation of International Search Report issued in PCT/EP015/068890, dated Oct. 21, 2015 (dated Nov. 3, 2015).
English abstract of KR1020090072252A.

*Primary Examiner* — Brian K Young
(74) *Attorney, Agent, or Firm* — thyssenkrupp North America, Inc.

(57) ABSTRACT

A military vessel may include a directable weapon and an antenna. The antenna can be swiveled from a first position, in which the antenna is disposed essentially vertically, into a second position, in which a height of the antenna above the military vessel is reduced to increase a directing range of the directable weapon compared to the first position. A method for operating a military vessel with a directable weapon and an antenna may involve swiveling the antenna from a first position, in which the antenna is disposed essentially vertically, into a second position, in which the height of the antenna above the vessel is reduced to increase the directing range of the weapon compared to the first position.

17 Claims, 5 Drawing Sheets

(51) Int. Cl.

| | |
|---|---|
| ***F41A 17/08*** | (2006.01) |
| ***H01Q 1/34*** | (2006.01) |
| ***H01Q 9/32*** | (2006.01) |
| ***H01Q 1/22*** | (2006.01) |
| ***H01Q 1/42*** | (2006.01) |
| ***H01Q 1/52*** | (2006.01) |
| ***H01Q 3/08*** | (2006.01) |

(52) U.S. Cl.
CPC ..... *H01Q 1/34* (2013.01); *H01Q 1/428* (2013.01); *H01Q 1/52* (2013.01); *H01Q 3/08* (2013.01); *H01Q 9/32* (2013.01)

(58) Field of Classification Search
USPC ..... 343/720
See application file for complete search history.

(56) References Cited

U.S. PATENT DOCUMENTS

| | | | | |
|---|---|---|---|---|
| 4,194,432 | A | 3/1980 | Conway et al. | |
| 5,227,806 | A * | 7/1993 | Eguchi | H01Q 1/18 342/359 |
| 8,207,902 | B1 * | 6/2012 | Tam | H01Q 1/1242 343/710 |
| 9,231,297 | B2 * | 1/2016 | Clement | H01Q 1/34 |
| 2012/0312876 | A1 | 12/2012 | Bland | |
| 2013/0300620 | A1 | 11/2013 | Gervais | |

* cited by examiner

MILITARY VESSEL

CROSS REFERENCE TO RELATED APPLICATIONS

This application is a U.S. National Stage Entry of International Patent Application Serial Number PCT/EP2015/068890, filed Aug. 18, 2015, which claims priority to German Patent Application No. DE 10 2014 114 571.2 filed Oct. 18, 2014, the entire contents of which are incorporated herein by reference.

FIELD

The present disclosure generally relates to military vessels, including military vessels with directable weapons and antennas, as well as to methods for operating such military vessels.

BACKGROUND

Such military vessels can for example be in the form of frigates, corvettes, patrol ships, aircraft carriers or helicopter carriers. For defense, weapons that are directable in azimuth and/or elevation, such as for example guns or launchers, are usually provided on the decks of such ships. Furthermore, as a rule such military vessels comprise antennas, by means of which the vessels can communicate with other aircraft or with vessels or with a control station, or by means of which awareness measures can be carried out. US 2013/0 300 620 A1 discloses an apparatus for remotely controlled erecting and laying down of an antenna of a vessel. KR 10 2009 0 072 252 A discloses a system for automatically adjusting the height of a radar or radio mast of a ship. U.S. Pat. No. 4,164,165 A discloses a safety device for a firing device, with which the current direction of the applied firing device is detected and is compared with stored directions in order to inhibit firing if the firing device is pointing in an unsafe direction. US 2012/0 312 876 A1 discloses a method for determining the probability of a collision between projectiles fired from a platform and fired interception means and names as examples a warship with guns and rockets.

With such military vessels, it has been found to be a disadvantage that the directing range of the weapon is limited by the antenna usually protruding high above the hull of the vessel.

DETAILED DESCRIPTION

Figure 1:
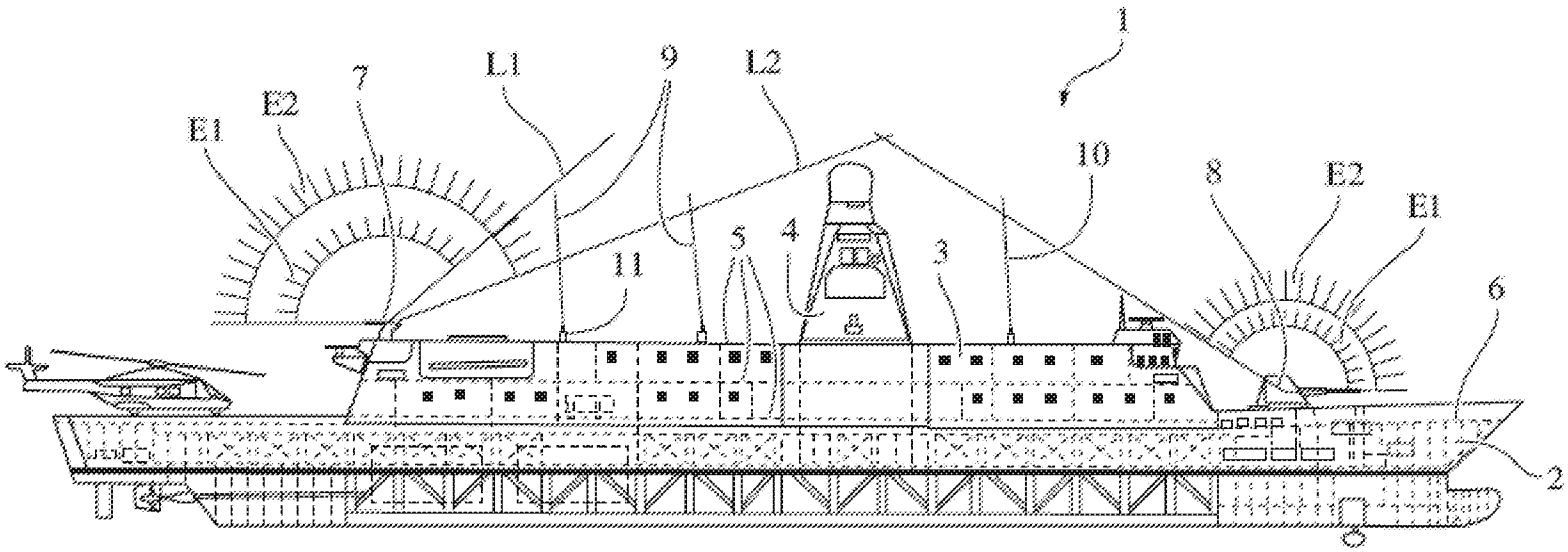
FIG. 1 is a lateral sectional view of an example military vessel.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

One example object of the present disclosure is to increase a directing range of a weapon.

The object is achieved by a military vessel with a directable weapon and an antenna, wherein the antenna can be swiveled from a first position, in which the antenna is essentially disposed vertically, into a second position, in which the height of the antenna above the vessel is reduced to increase the directing range of the weapon compared to the first position.

In the first position of the antenna, the antenna can have improved reception and/or transmission properties compared to the second position, wherein however the directing range of the weapon is limited by an interfering contour of the antenna. In the second, swiveled position of the antenna, the interfering contour of the antenna that is restricting the directing range of the weapon is reduced. Consequently, the directing range of the weapon increases in azimuth and/or in elevation. It is advantageous if the antenna can be completely swiveled out of the directing range of the weapon, so that the directing range is no longer restricted by the antenna in the second position of the antenna.

It is advantageous if the second position of the antenna is continuously adjustable, so that a plurality of positions of the antenna can be achieved, in which the height of the antenna above the vessel is reduced compared to the first position.

Preferably, the antenna is essentially horizontally disposed in the second position. Owing to the horizontal orientation of the antenna in the second position, the restriction of the directing range of the weapon in elevation can be kept as small as possible. Particularly preferably, in the second position the antenna is disposed below a horizontal plane passing through an elevation directing axis of the weapon, so that the directing range of the weapon in elevation is not restricted by the antenna.

An advantageous embodiment provides that in the second position a free end of the antenna is disposed in a region on the side of a hull of the vessel, so that it is not necessary to keep a free region above the hull for swiveling the antenna. In the second position, the free end of the antenna can be disposed laterally above the hull or laterally next to the hull. It is particularly advantageous if a significant part of the antenna is essentially to the side of the hull in the second position.

It is further advantageous if the antenna can be swiveled in a swivel plane that encloses an angle with the longitudinal axis of the hull, so that the antenna can be swiveled laterally away from the hull of the vessel, especially to port or to starboard. With such an embodiment, the swivel axis about which the antenna can be swiveled is disposed at an angle to a lateral axis of the hull. By swiveling the antenna to the side, degradation of the directing range of such weapons that are disposed in the region of the bow and/or in the region of the stern of the vessel can be reduced.

One structural embodiment provides that the swivel plane is disposed perpendicular to the longitudinal axis. With such an embodiment, the swivel axis is disposed parallel to the longitudinal axis of the hull.

It has been found to be advantageous if the swivel plane is disposed parallel to an imaginary connecting line between the antenna and the weapon. By such an arrangement of the swivel plane, the interfering contour of the antenna can in particular be reduced in such cases in which the antenna is disposed above a horizontal line passing through the weapon in the second position. The swivel plane is preferably disposed parallel to an imaginary connecting line between a connection point of the antenna to the hull and an azimuth directing axis of the weapon.

A preferred embodiment provides that the antenna can be swiveled about a swivel axis disposed in the edge region of a deck of the vessel, so that the antenna can be swiveled into a position lying to the side of the hull, in particular to port or to starboard.

Furthermore, it has proved to be advantageous if the antenna can be locked in the first position and/or in the second position, so that the antenna can be fixed relative to the hull of the vessel in the first position and/or in the second position. The antenna can be locked by means of a locking bolt. The locking bolt can be brought into engagement with a corresponding locking means by means of a preferably electrically driven cylinder in order to fix the antenna in the first position and/or in the second position.

According to one advantageous embodiment, it is provided that the antenna can be swiveled by means of a motorized swiveling device. With the motorized swiveling device it is not necessary to swivel the antenna manually. The swiveling device can for example comprise a stepper motor, by means of which it is possible to swivel the antenna into various reduced height positions. Preferably, the swiveling device comprises a rotatably supported shaft on which the antenna is disposed. The shaft can have a receiving region for receiving the shaft, which is in the form of a cylinder.

In this connection, it has proved to be advantageous if the swiveling device comprises a housing and a sealing device disposed between the housing and the shaft for sealing against water, so that the ingress of water into the housing and/or into the region of the shaft can be prevented.

Preferably, the swiveling device is rigidly connected to a deck of the vessel. Alternatively, the swiveling device can be elastically connected to the deck, in particular by means of a spring element.

Preferably, the antenna is in the form of a linear, in particular rod-shaped, antenna. The antenna can be in the form of a mast.

One advantageous embodiment provides that the vessel comprises a transmitter and/or a receiver and an adjustment device for adapting the antenna impedance to the transmitter and/or the receiver, wherein the adjustment device is adjustable such that the antenna impedance can be adjusted in the first position of the antenna and in the second position of the antenna. In this respect, it is possible to use the antenna both in the first position and also in the second position for receiving and/or transmitting radio signals.

A method for operating a military vessel with a directable weapon and an antenna contributes further to achieving the aforementioned object, wherein the antenna is swiveled from a first position, in which the antenna is disposed essentially vertically, into a second position, in which the height of the antenna above the vessel is reduced to increase the directing range of the weapon compared to the first position.

The same advantages are achieved with the method that have already been described in connection with the military vessel according to the invention.

According to a preferred embodiment, the antenna is swiveled into the second position if the weapon adopts a predetermined elevation directing position and/or a predetermined azimuth directing position. This has the advantage that the antenna can then be swiveled into the reduced height second position thereof if the weapon is directed in an elevation range and/or an azimuth range in which the antenna thereof forms an interfering contour for the weapon in the first position. If the weapon is not directed in said elevation region and/or azimuth region, then the antenna can remain in the first position thereof, because there is no fear of a degradation of the directing range of the weapon.

It is advantageous if the second position of the antenna is continuously adjusted so that the antenna can be swiveled into different positions in which the height of the antenna above the vessel is reduced compared to the first position. It is particularly advantageous if the antenna is swiveled, in particular continuously, depending on the directing setting of the weapon in azimuth and/or elevation.

Alternatively or additionally, the advantageous features that were described in connection with the military vessel can be used with the method according to the invention.

Further details, features and advantages of the invention are revealed by the illustrations, as well as by the following description of preferred embodiments using the illustrations. Here the illustrations only illustrate exemplary embodiments of the invention that do not limit the ideas of the invention.

In FIG. 1, a military vessel 1 in the form of a surface vessel is represented. The vessel 1 comprises a hull 2, above which a main deck 6 is provided. On the main deck 6 there is a structure 3 of the vessel 1 comprising a plurality of decks 5. A tower 4 is provided on the structure 3. As protective equipment, the vessel 1 comprises a first directable weapon 7 that is disposed on an upper deck 5 in the region of the stern. Furthermore, a second directable weapon 8 is provided in the region of the bow on a main deck 6. The directable weapons 7, 8 are preferably directable in azimuth and/or elevation. According to the exemplary embodiment, the weapons 7, 8 are in the form of guns.

In order to be able to communicate with other vessels and/or a control station, the vessel 1 comprises a plurality of antennas 9, 10. According to the exemplary embodiment, the antennas 9, 10 are disposed on the upper deck 5, but can also be disposed on another deck. The antennas 9, 10 are designed as linear, rod-shaped antennas. In the first position represented in FIG. 1, the antennas 9, 10 are vertically oriented. In this respect, the antennas protrude upwards from the vessel 1 in the first position.

In the representation in FIG. 1, the elevation directing regions of the weapons 7, 8 are represented as light shaded angular regions E1. The directing range of the weapon 7 is limited in elevation by the upright antenna 9. This means that the weapon 7, if it is pointing in the direction of the bow, can only be directed in elevation above an imaginary connecting line L1 between the weapon 7 and the free end of the aft antenna 9. To this extent, the antenna 9 has an interfering contour that restricts the directing range of the weapon 7. In order to increase the directing range of the weapons 7, 8, the antennas 9, 10 can be swiveled from a first position, in which the antennas 9,10 are essentially vertically disposed, into a second position, in which the height of the antennas 9, 10 is reduced to increase the directing range of the weapons 7, 8 compared to the first position. For this purpose, the antennas 9, 10 are designed to be swiveled by means of a swiveling device 11 that is disposed at the foot of the antennas.

The elevation directing range of the weapon 7 is represented as a dark shaded angular region E2. It can be seen that the elevation directing range of the weapon 7 in the second position of the antenna 9 is increased compared to the first position. The directing range of the weapon 7 is not restricted by the antenna 9 in the second position of the antenna 9, but by the tower 4, cf. the imaginary connecting line L2 between the weapon 7 and the contour of the tower.

The swiveling of the antennas 9 into the second position is preferably carried out if the weapon 7 adopts a predetermined elevation directing position and/or a predetermined azimuth directing position, so that the swiveling of the antennas 9 is only then carried out if the antennas 9 are actually forming an interfering contour for the weapon 7.

Figure 2:
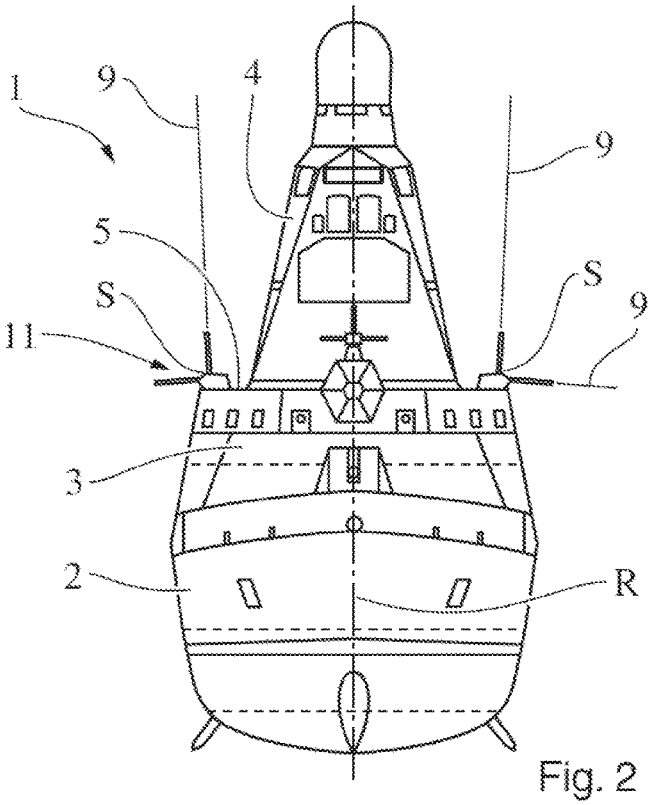
FIG. 2 is a front view illustrating a bow of the example military vessel of FIG. 1.

To illustrate the swivel plane of the antennas 9, 10, in FIG. 2 an antenna 9 is shown both in the first, upright position and also in the swiveled second position. In the second position, the antenna 9 is swiveled clockwise by approx. 90° about a swivel axis S compared to the first position. The swivel plane of the antenna 9 is thereby the same as the plane of the drawing and runs parallel to a lateral axis of the hull 2 or perpendicular to a longitudinal axis of the hull 2. In the second position, the free end of the antenna 9 is disposed to the side of the hull 2. Because the swivel axis S is disposed in the edge region of the deck 5 and the antenna 9 is swiveled away from the tower 4 of the ship in the second position, the antenna 9 is essentially to the side of the hull 2 in the second position. In this respect, the overall width of the vessel 1 increases by the length of the antenna 9.

Figure 3:
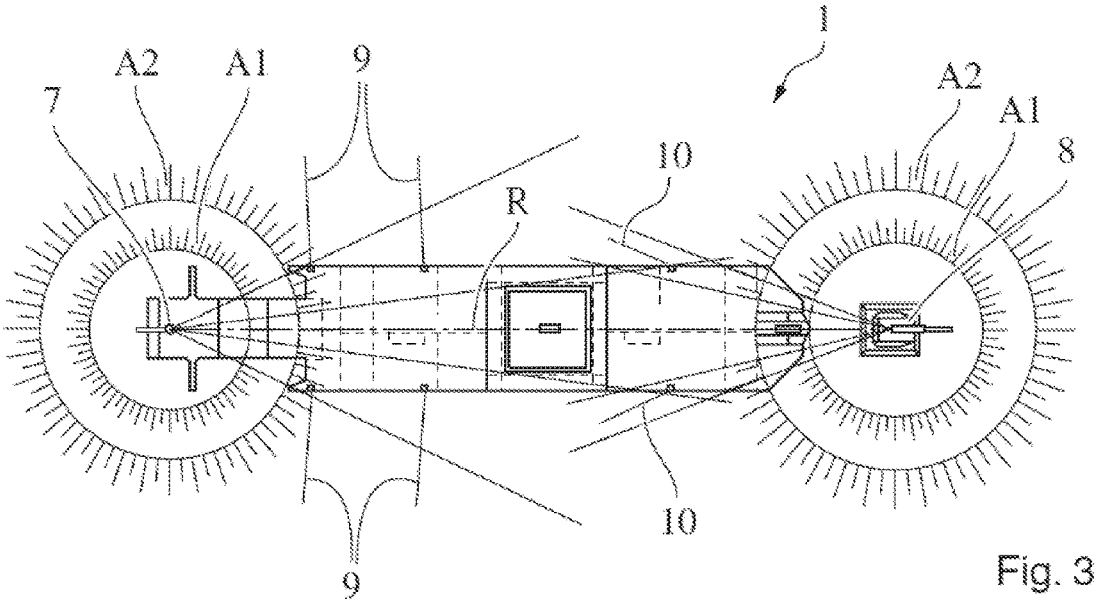
FIG. 3 is a top view illustrating a deck area of the example military vessel of FIG. 1.

FIG. 3 shows the antennas 9, 10 in the second, swiveled position, in which the antennas 9, 10 restrict the directing range of the weapons 7, 8 to a lesser extent than in the first, upright position shown in FIG. 1. In the second position, the antennas 9, 10 are swiveled in a region from 45° to 120°, preferably in a region from 70° to 110°, particularly preferably by approximately 90° compared to the first position. The antennas 9, 10 can be disposed horizontally in the second position for example. In the first, upright position of the antennas 9, 10, the directing range of the weapons 7, 8 is limited in azimuth by the interfering contours of the antennas 9, 10, cf. the light-shaded angular regions A1. In the second position of the antennas 9, 10, the directing range of the weapons 7, 8 is increased in azimuth, cf. the dark-shaded angular regions A2. The antennas 9, 10 can each be swiveled in a swivel plane that encloses an angle with the longitudinal axis R of the hull 2. However, there are differences regarding the selection of the size of the angle. The swivel plane of the antennas 9 encloses an angle of approx. 90° with the longitudinal axis R of the hull 2. The antennas 10, on the other hand, can be swiveled in a swivel plane that runs parallel to an imaginary connecting line between the azimuth directing axis of the weapon 8 and the foot of the antennas 10. Thereby, the swivel plane of the antennas 10 lies effectively in the "firing direction" of the weapon 8. This arrangement of the swivel plane is advantageous, because the weapon 8 is disposed below the foot of the antenna 10 and it is not possible to swivel the antenna 10 completely out of the directing range of the weapon 8.

Using the representations in FIGS. 4 through 7, a first exemplary embodiment of a swiveling device 11 by means of which the antennas 9, 10 can be swiveled will be described below. The swiveling device 11, in particular a supporting plate 28 of the swiveling device 11, is rigidly connected to the deck 5 by means of a base 24.

Figure 4:
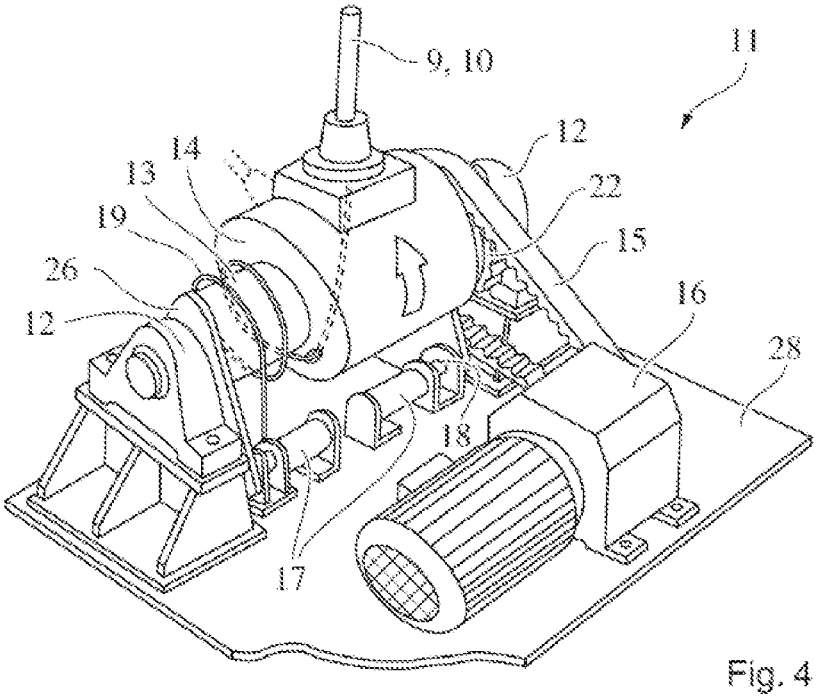
FIG. 4 is a perspective view of an example swiveling device for an antenna.

As represented in FIG. 4, the swiveling device 11 comprises a shaft 13 that is rotatably supported in two pedestal bearings 12. An especially cylindrical receptacle 14 for the antenna 9, 10 is provided on the shaft 13. The foot of the antenna 9, 10 is accommodated in the receptacle 14. A gear wheel 22 that is connected to a drive 16 by means of a toothed belt 15 sits on the shaft 13. The drive 16 can be controlled by means of two, in particular mechanical, end switches that are not shown in the figures, so that the antenna 9, 10 can be swiveled back and forth between the first position and the second position by the drive 16. In addition, contactless proximity switches for detecting the position of the shaft can be provided. Using the proximity switches, a transmitter and/or receiver connected to the antenna 9, 10 can be switched off while the antenna 9, 10 is being swiveled, which is also referred to as "blanking".

A cable 19 connection of the antenna 9, 10 to a transmitter and/or a receiver is connected to the antenna 9, 10. The cable 19 runs through the interior of the receptacle 14, exits from the receptacle 14 and then runs in a spiral about the shaft 13. Preferably, the shaft 13 comprises a soft sheath at least in the region in which the cable 19 runs about the shaft 13, so that damage to the cable 19 can be reduced. The cable 19 runs through a clamping frame 23 disposed in the plane of the deck 5 into the interior of the structure 3.

Figure 5:
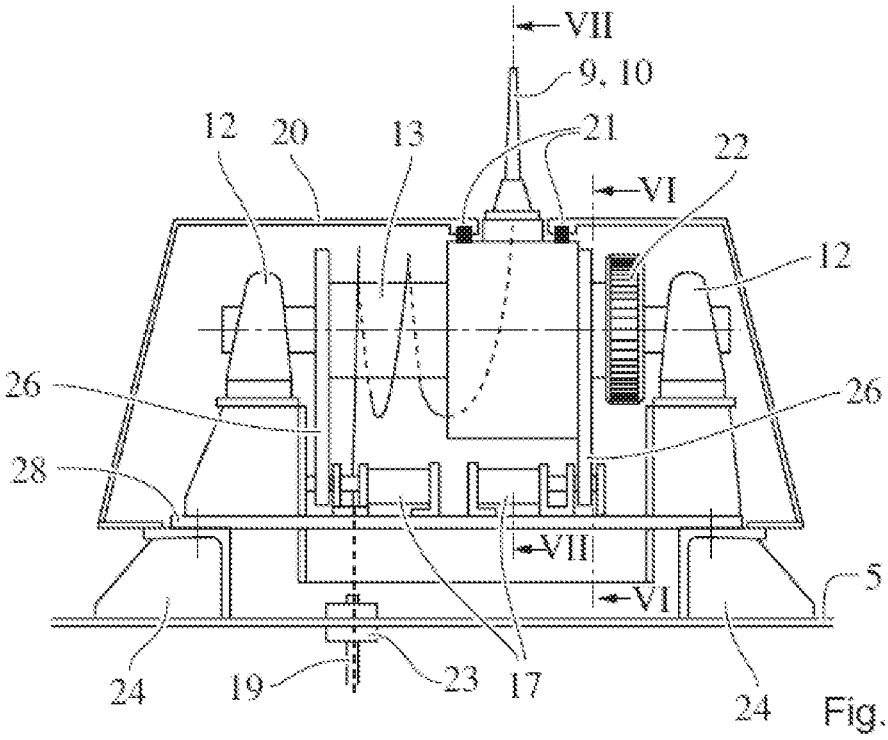
FIG. 5 is a sectional view of the example swiveling device of FIG. 4 with a housing.

FIG. 5 shows that the swiveling device 11 comprises a housing 20 that protects the mechanism of the swiveling device, in particular the shaft 13, against external effects. For protection against water, a seal 21 is provided between the housing 20 and the shaft 13, in particular the receptacle 14 for the shaft 13.

Figure 6:
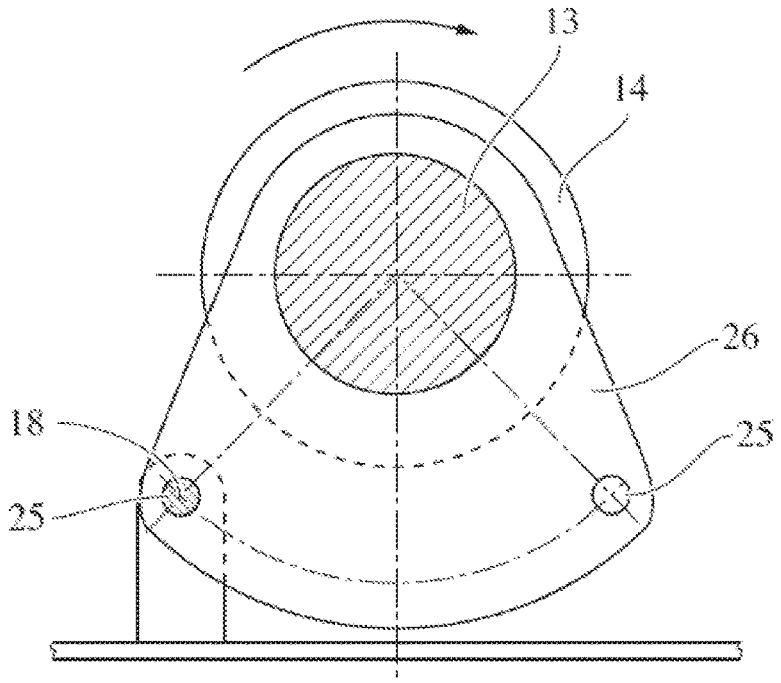
FIG. 6 is a sectional view of the swiveling device of FIG. 4 taken across line VI-VI in FIG. 5.

Furthermore, a plate 26 that can rotate with the shaft 13 is disposed on the shaft 13. As shown in FIG. 6, the plate 26 comprises two openings 25 that can accept a locking bolt 18 in the first and second positions of the antenna 9, 10 in order to fix the antenna 9, 10 in the respective position. The locking bolt is movable linearly by means of an especially electrically driven cylinder 17. Preferably, two plates 26 are disposed on the shaft 13 for locking the antenna 9, 10.

Figure 7:
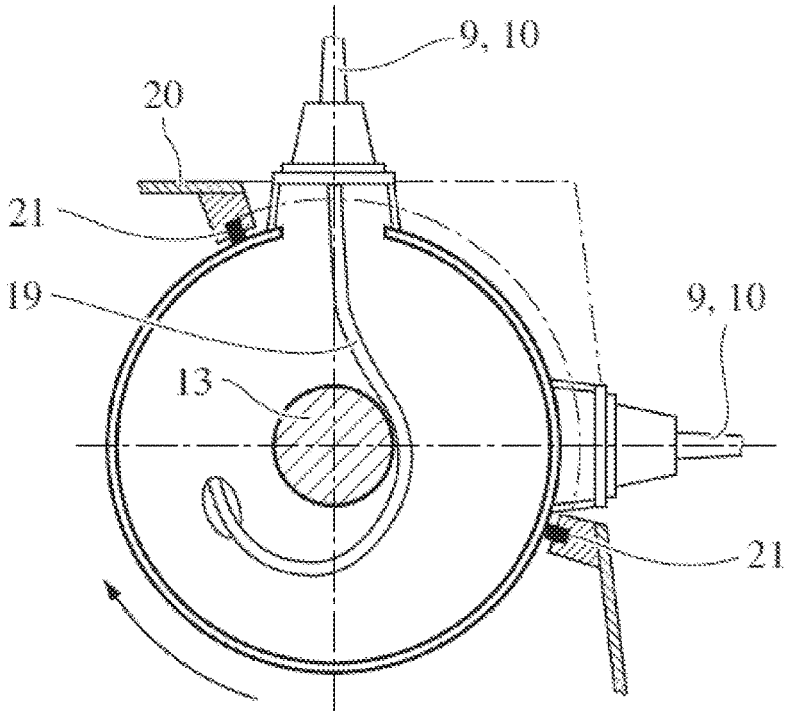
FIG. 7 is a sectional view of the swiveling device of FIG. 4 taken across line VII-VII in FIG. 5.

FIG. 7 shows a sectional representation through the receptacle 14 for the shaft 13. It can be seen that the seal 21 seals the housing 20 relative to the receptacle 14.

Figure 8:
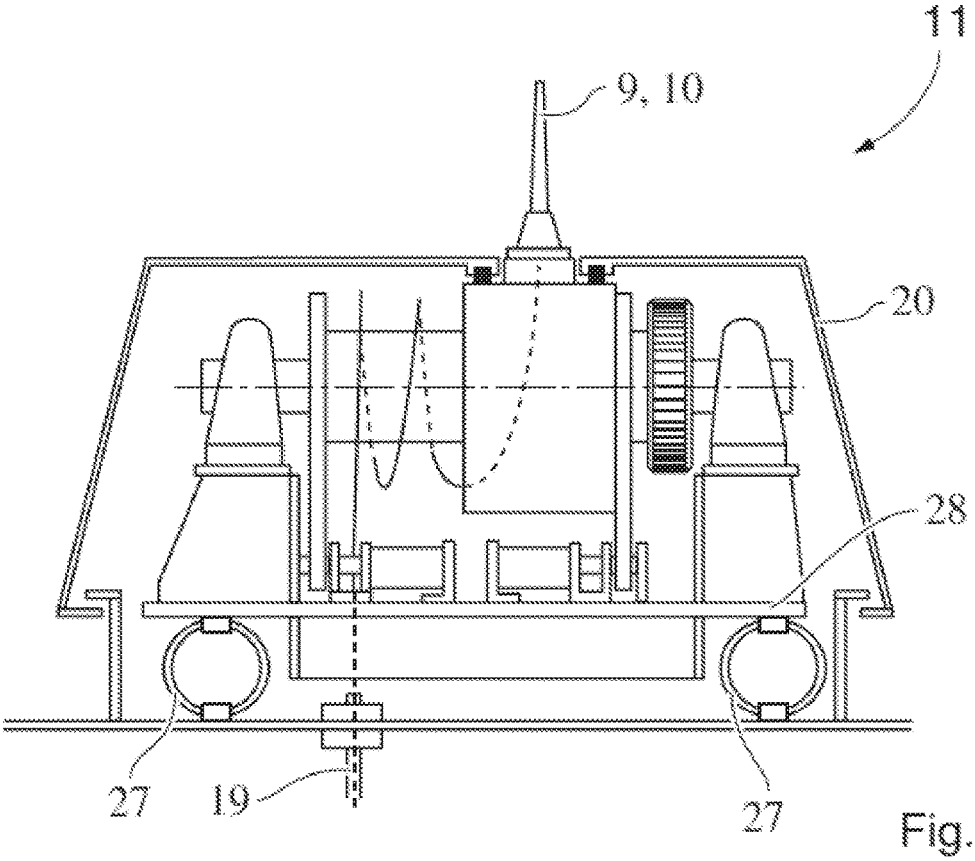
FIG. 8 is a sectional view of another example swiveling device.

In FIG. 8 a second exemplary embodiment of a swiveling device 11 for an antenna 9, 10 is represented. In contrast to the swiveling device 11 according to the first exemplary embodiment, the swiveling device 11 is elastically connected to the deck 5 of the vessel 1. For this purpose, the swiveling device 11 comprises spring elements 27 that are disposed between a supporting plate 28 of the swiveling device and the deck 5.

An adjustment device for adjusting the antenna impedance can also be provided on the vessel 1 between the antenna 9, 10 and a transmitter and/or receiver. Preferably, two operating states can be stored in the adjustment device, so that a first setting for the first position of the antenna 9, 10 and a second setting for the second position of the antenna 9, 10 can be stored. This enables the antenna 9, 10 to use radio traffic in the first position and in the second position.

By swiveling the antenna 9, 10, the radiation behavior of the antenna 9, 10 can be influenced, as will be described below. In the first, essentially vertical, position of the antenna 9, 10, the radiation angle of the antenna 9, 10 is rather flat, for which reason when radiating electromagnetic waves in the HF range reflections occur at the ionosphere only at a great distance from the vessel 1. In the first position, the antenna 9, 10 therefore has improved radiation behavior for connections to far distant receivers. In the second position the antenna 9, 10 is in a lowered, in particular horizontal position. The radiation angle of the antenna 9, 10 in the second position is rather steep, i.e. the primary radiation direction is essentially vertical. Electromagnetic waves in the HF range are therefore reflected above the vessel 1 at the ionosphere and returned to the vicinity of the vessel 1. This results in improved radiation behavior for connections to nearby receivers.

In contrast to the exemplary embodiment described above, the antennas 9, 10 of the vessel 1 can be continuously swiveled and/or locked, so that the reduced height second position of the antennas 9, 10 is continuously adjustable. For example, the swivel position of the antennas 9, 10 can be adjusted depending on the azimuth directing position and/or the elevation directing position of the weapons 7, 8.

The vessel 1 described above comprises a directable weapon 7, 8 and an antenna 9, 10 that can be swiveled from a first position, in which the antenna 9, 10 is essentially vertically disposed, into a second position, in which the height of the antenna 9, 10 above the vessel 1 is reduced to increase the directing range of the weapon 7, 8 compared to the first position. In this respect, the angle of coverage of the weapon 7, 8 can be increased by swiveling the antenna 9, 10 into the second position thereof.

REFERENCE CHARACTER LIST

1 military vessel
2 hull
3 structure
4 tower
5 deck
6 deck
7 weapon
8 weapon
9 antenna
10 antenna
11 swiveling device
12 pedestal bearing
13 shaft
14 receptacle resp. receiving region
15 toothed belt
16 drive
17 cylinder
18 locking bolt
19 cable
20 housing
21 seal
22 gear wheel
23 clamping frame
24 base
25 opening
26 plate
27 spring element
28 supporting plate
A1, A2 directing range in azimuth
E1, E2 directing range in elevation
L1, L2 imaginary connecting lines
R longitudinal axis
S swivel axis

What is claimed is:

1. A military vessel comprising:
a directable weapon; and
an antenna configured to be swiveled from a first position in which the antenna is disposed substantially vertically to a second position in which a height of the antenna above the vessel is reduced to increase a directing range of the directable weapon relative to the first position,
wherein the antenna is configured as a linear antenna.

2. The military vessel of claim 1 wherein the antenna is disposed substantially horizontally in the second position.

3. The military vessel of claim 1 wherein a free end of the antenna is disposed in a region of a side of a hull of the military vessel in the second position.

4. The military vessel of claim 1 wherein the antenna swivels in a swivel plane that encloses an angle with a longitudinal axis of a hull of the military vessel.

5. The military vessel of claim 4 wherein the swivel plane is disposed perpendicularly to the longitudinal axis of the hull.

6. The military vessel of claim 4 wherein the swivel plane is parallel to an imaginary connecting line extending between the antenna and the directable weapon.

7. The military vessel of claim 1 wherein the antenna swivels about a swivel axis that is disposed in an edge region of a deck of the military vessel.

8. The military vessel of claim 1 further comprising a locking bolt for locking the antenna in at least one of the first position or the second position.

9. The military vessel of claim 1 further comprising a motorized swiveling device for swiveling the antenna.

10. The military vessel of claim 9 wherein the motorized swiveling device is rigidly or elastically connected to a deck of the vessel.

11. The military vessel of claim 9 wherein the motorized swiveling device comprises a rotatably supported shaft on which the antenna is disposed.

12. The military vessel of claim 11 wherein the motorized swiveling device comprises a housing and a sealing device for sealing against water that is disposed between the housing and the shaft.

13. The military vessel of claim 1 wherein the antenna is configured as a rod-shaped antenna.

14. The military vessel of claim 1 further comprising:
at least one of a transmitter or a receiver; and
an adjustment device for adapting antenna impedance to the at least one of the transmitter or the receiver, wherein the adjustment device is adjustable such that the antenna impedance is adjustable when the antenna is in the first and second positions.

15. A method for operating a military vessel that includes a directable weapon and a linear antenna, the method comprising swiveling the linear antenna from a first position in which the linear antenna is substantially vertically disposed to a second position in which a height of the linear antenna above the military vessel is reduced to increase a directing range of the directable weapon relative to the first position.

16. The method of claim 15 comprising swiveling the linear antenna to the second position if the directable weapon adopts at least one of a predetermined elevation directing position or a predetermined azimuth directing position.

17. A method for operating a military vessel that includes a directable weapon and an antenna, the method comprising swiveling the antenna from a first position in which the antenna is substantially vertically disposed to a second position in which a height of the antenna above the military vessel is reduced to increase a directing range of the directable weapon relative to the first position, and swiveling the antenna to the second position if the directable weapon adopts at least one of a predetermined elevation directing position or a predetermined azimuth directing position.

* * * * *